United States Patent [19]

Carrigan

[11] Patent Number: 4,747,568

[45] Date of Patent: May 31, 1988

[54] MISSILE FLIGHT CONTROL SYSTEM

[75] Inventor: Thomas F. Carrigan, Bradford, England

[73] Assignee: Lucas Industries plc, Birmingham, England

[21] Appl. No.: 43,856

[22] Filed: Apr. 29, 1987

[30] Foreign Application Priority Data

May 9, 1986 [GB] United Kingdom ..... 8611406

[51] Int. Cl.[4] ..... F42B 15/033

[52] U.S. Cl. ..... 244/3.22

[58] Field of Search ..... 244/3.22, 3.21, 3.24

[56] References Cited

U.S. PATENT DOCUMENTS

| | | | |
|---|---|---|---|
| 3,637,167 | 1/1972 | Froning, Jr. et al. | 244/3.21 |
| 4,085,909 | 4/1978 | East et al. | 244/3.22 |
| 4,560,121 | 12/1985 | Terp | 244/3.22 |

*Primary Examiner*—Charles T. Jordan

*Attorney, Agent, or Firm*—Nixon & Vanderhye

[57] ABSTRACT

A missile flight control system includes a plurality of fins movable by actuators and a corresponding plurality of valves each of which regulates gas flow through a pair of outlets which are oppositely directed perpendicularly of the missile axis, the valve being operated by respective ones of the actuators.

3 Claims, 3 Drawing Sheets

MISSILE FLIGHT CONTROL SYSTEM

It is known to control the flight of missiles by means of movable fins. In the initial stages of flight of such a missile from a stationary platform the missile speed may be insufficient to enable the fins to exert aerodynamic control.

It is an object of the invention to provide a system in which flight control is assisted by gas streams which are responsive to movements of the fins.

According to the invention a flight control system for a missile comprises a plurality of movable fins, a corresponding plurality of actuators for said fins and means, responsive to operation of said actuators, for directing a gas stream transversely of the missile axis to alter the orientation of the missile in a direction required by actuator operation, said means for directing a gas stream comprises a plurality of pairs of gas outlets, each of said pairs being associated with a respective one of said fins and being arranged to emit gas streams in opposite directions substantially perpendicular to said missile axis, and a plurality of valves operable by the respective actuators for controlling gas flow to the outlets of the respective pairs thereof.

Figure 1:
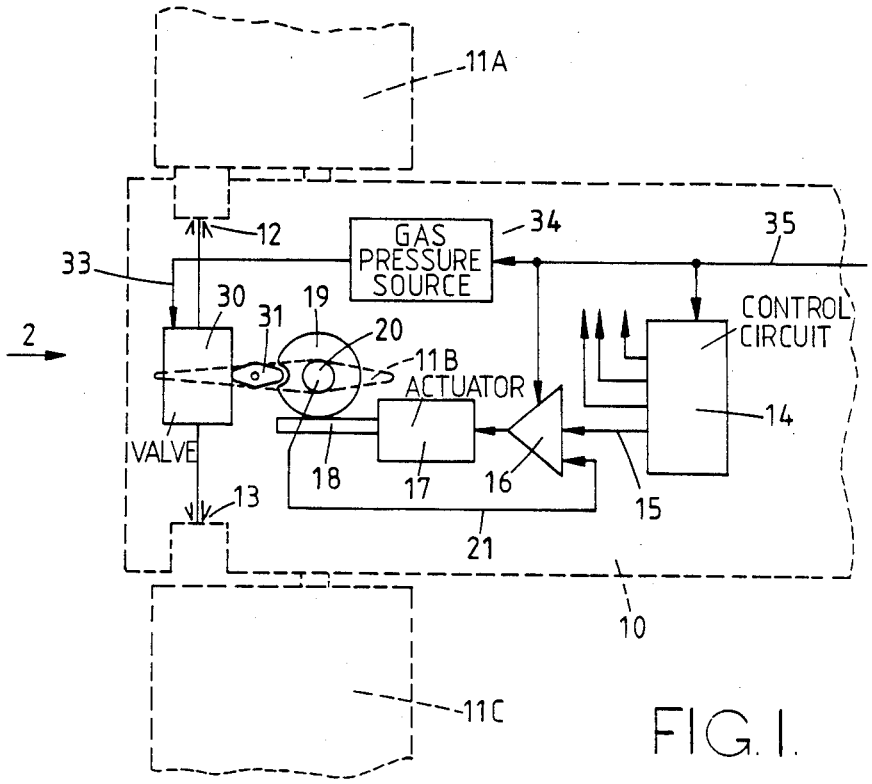
Figure 2:
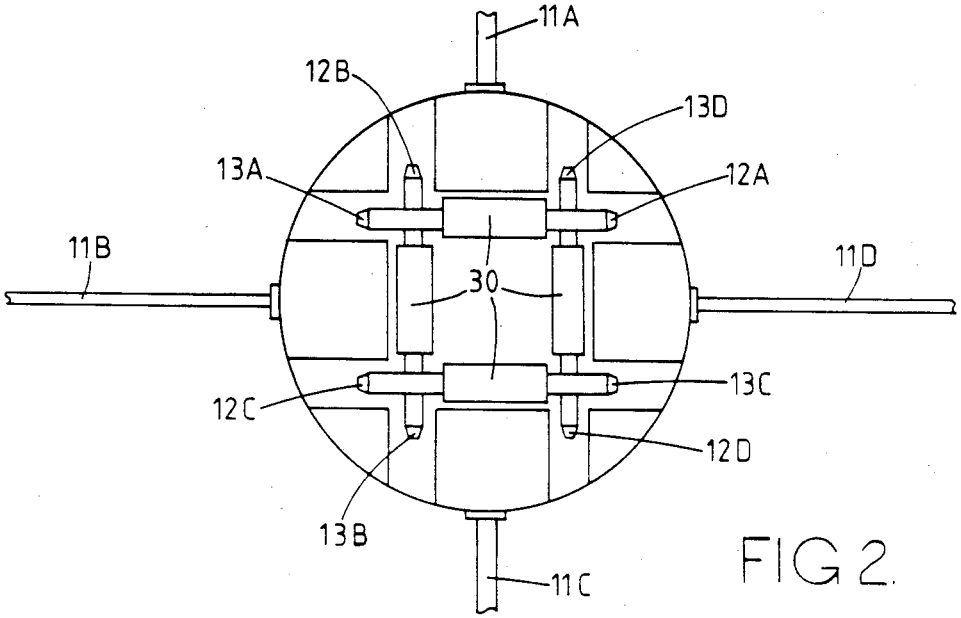
Figure 3:
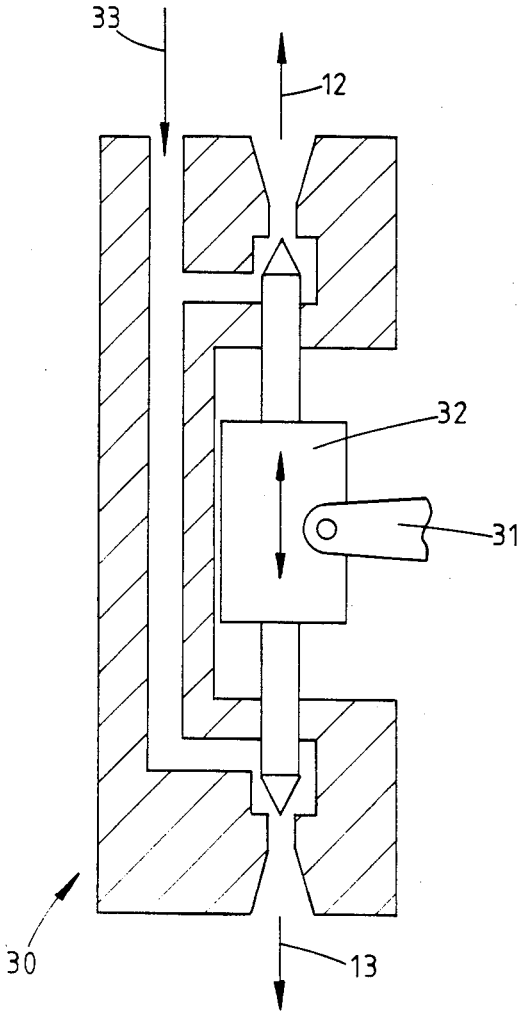

An embodiment of the invention will now be described by way of example only and with reference to the accompanying drawings in which:

FIG. 1 is a diagrammatic view of a control for a single fin and an associated pair of gas outlets, FIG. 2 is a view on arrow 2 in FIG. 1, showing all four fins and their associated gas outlets, FIG. 3 is a diagram of a valve forming part of FIG. 1, and FIGS. 4, 5 and 6 show effects of operation of the gas jets to obtain pitch, roll and yaw.

As shown in FIG. 1 the rear end of a missile, indicated at 10, carries four fins only three 11A, 11B, 11C of which are shown in that figure. The fins are movable to effect steering of the missile. FIG. 1 shows diagrammatically a control arrangement for the fin 11B and an associated pair of gas outlet nozzles 12, 13. A control circuit 14 provides an output signal on a line 15 in response to a steering requirement which involves the fin 11B. The circuit 14 also provides signals on three additional lines to corresponding arrangements for controlling the remaining fins 11A, 11C, 11D. The signal on line 15 is supplied to an amplifier 16 whose output drives an electromechanical actuator 17. The output element of the actuator 17 is a rack 18 which engages a pinion 19 secured to a shaft 20 of the fin 11B. A feedback signal corresponding to the position of the fin 11B is supplied on a line 21 to the amplifier 16. The travel of the rack 18 is such that the fin 11B is movable 30° either side of its central position shown.

A valve 30, shown in more detail in FIG. 3, is operable by a lever 31 which is engageable by the pinion 19. Engagement between the lever 31 and pinion 19 is such that ±30° travel of the pinion 19 from its central position effects only ±2 mm movement of a control element 32 (FIG. 3) of the valve 30. The valve 30 is supplied with pressurised gas through a line 33 from a source 34, which may be a known form of chemical gas generator. Operation of the circuit 14, amplifier 16 and source 34 is initiated by a signal on a line 35, this signal being provided at launch of the missile.

As will be seen from FIG. 3 the control element is movable in either direction, from a central position in which gas is emitted equally from the nozzles 12, 13, to increase emission from either one of those nozzles. Rotation of the pinion 19 (FIG. 1) to move the fin 11B clockwise results in anticlockwise movement of the lever 31, increasing flow through the nozzle 12. This gas emission has an effect on the missile 10 which assists that of the fin 11B. The fins 11A, 11C, 11D are similarly provided, as shown in FIG. 2, with pairs of nozzles and with control arrangements corresponding to that shown in FIG. 1.

Figure 4:
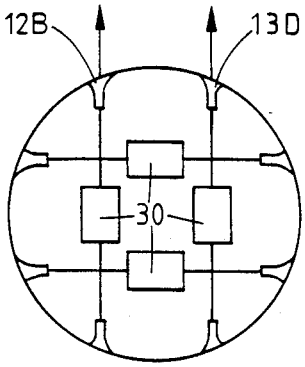
Figure 5:
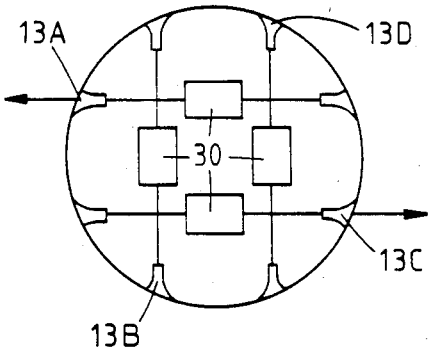
Figure 6:
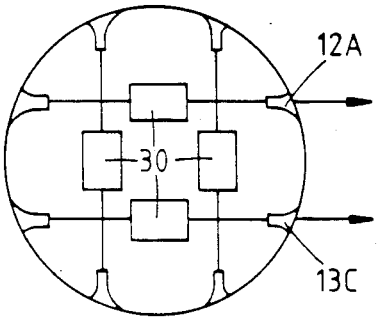

If the missile is required to pitch about an axis parallel to the axes of the fins 11B, 11D, only those fins will operate, increasing gas flows from the nozzles 12B, 13D as indicated in FIG. 4. This increase will impart pitch to the missile even if its speed is insufficient to cause the fins 11B, 11D to exert aerodynamic control. If the missile is required to roll clockwise, as viewed in FIG. 2, about its long axis, at least two of the fins, for example 11A, 11C, will move in opposite directions, increasing gas flows at nozzles 13A, 13C as shown in FIG. 5. If all four fins are operated to effect roll, increased flows will additionally be provided at nozzles 13D, 13B.

Yaw is effected in the same manner as pitch, except that fins 11A, 11C only operate, increasing flows at nozzles 12A, 13C.

The gas generator 34 (FIG. 1) is arranged so that gas generation progressively reduces over the time when the missile is increasing its speed, and will cease entirely by the time that a speed sufficient for aerodynamic control is reached. The effects of gas jets from the nozzles 12 thus progressively reduce from a maximum at launch. At initial low speeds of the missile the effect of the gas jets on its attitude will be large and consequently the amplitude of the signals from the control circuit 14 will be small. Subsequently these signals will be of larger amplitude to move the fins 11 through their maximim ranges of travel. Lost motion engagement between the lever 31 and pinion 19 is provided to prevent damage to the valve 30 and to avoid the need for precisely matching the strokes of the valve 30 and actuator 17. Provision for lost motion may include spring loading of the pivot of the lever 31.

I claim:

1. A flight control system for a missile comprising a plurality of movable fins, a corresponding plurality of actuators for said fins and an arrangement responsive to operation of the actuators for directing gas streams transversely of the missile axis to alter orientation of the missile in a direction required by operation of the actuators, said arrangement for directing gas streams comprising a plurality of pairs of gas outlets, each of said pairs of outlets being arranged to emit gas streams in opposite directions substantially perpendicular to the missile axis, gas flow to said pairs of outlets being regulated by respective valves which are operable by respective ones of said actuators, said valves being coupled to the respective actuators through lost motion connections.

2. A system according to claim 1 in which each of said valves is operable from a central position in which each outlet in a corresponding pair thereof emits an equal gas stream, to a position in which the gas stream through one of said outlets is increased.

3. A system according to claim 1 in which at least two of said valves are operated for any change of attitude of the missile.

* * * * *